US006554457B1

(12) United States Patent
Platt

(10) Patent No.: US 6,554,457 B1
(45) Date of Patent: Apr. 29, 2003

(54) SYSTEM FOR LAMP RETENTION AND RELAMPING IN AN ADJUSTABLE TRIM LIGHTING FIXTURE

(75) Inventor: Kenneth R. Platt, Mt. Prospect, IL (US)

(73) Assignee: Juno Lighting, Inc., Des Plaines, IL (US)

( * ) Notice: Subject to any disclaimer, the term of this patent is extended or adjusted under 35 U.S.C. 154(b) by 0 days.

(21) Appl. No.: 09/672,882

(22) Filed: Sep. 28, 2000

(51) Int. Cl.[7] ..... F21V 15/00

(52) U.S. Cl. ..... 362/365; 362/366; 362/287; 362/269

(58) Field of Search ..... 362/365, 366, 362/269, 287

(56) References Cited

U.S. PATENT DOCUMENTS 5,481,443 A * 1/1996 Wagner et al. ..... 362/153.1
5,630,663 A 5/1997 Ling et al.
5,649,760 A * 7/1997 Beadle ..... 362/270
5,677,669 A * 10/1997 Walkley, IV et al. ..... 340/473
5,934,788 A 8/1999 Wolfe
5,944,412 A 8/1999 Janos
5,951,151 A * 9/1999 Doubeck et al. ..... 362/365
6,030,102 A 2/2000 Gromotka
6,045,241 A 4/2000 Pahl
6,068,387 A 5/2000 Hilton

* cited by examiner

*Primary Examiner*—Sandra O'Shea
*Assistant Examiner*—Ronald E. DelGizzi
(74) *Attorney, Agent, or Firm*—Sonnenschein Nath & Rosenthal

(57) ABSTRACT

Disclosed is a lighting fixture apparatus that provides easy lamp, lens, or filter replacement and a method for replacing a lamp, lens, or filter in an adjustable lighting fixture apparatus. The apparatus comprises a frame, a gimble ring, and a lamp. The frame comprises a stop edge and at least one recess and the gimble ring comprises an interior and exterior portion and at least one guide pin extending from the exterior portion. The guide pin fits within the recess of the frame and rotates until it reaches the stop edge to lock the gimble ring in place or to align with the recess for removal.

51 Claims, 4 Drawing Sheets

SYSTEM FOR LAMP RETENTION AND RELAMPING IN AN ADJUSTABLE TRIM LIGHTING FIXTURE

TECHNICAL FIELD OF THE INVENTION

The invention relates to lighting fixtures and, in particular, an apparatus for easy lamp, lens, or filter replacement.

BACKGROUND OF THE INVENTION

Overhead lighting is often used, especially in commercial and residential environments, to emphasize various features within a room. In these settings, overhead lighting may be used to accent floor items, such as displays, or wall items, such as paintings. In addition, the strategic placement of overhead lighting may create a certain ambiance.

Lighting fixtures, especially those used in ceilings, are well known. Overhead lighting may include but is not limited to adjustable, recessed, trac, flush, and downlight fixtures. Such fixtures comprise a housing affixed to the ceiling structure and a lamp mounting structure and may rotate about vertical and horizontal axes. It is generally known in the art that lighting fixtures may swivel up to 360° horizontally and up to at least 75° vertically.

One problem with overhead lighting, however, is that the lighting fixture may include units that are small in size and therefore not amenable to easy removal for lamp, lens, or filter replacement. These are often-time consuming and frustrating processes. In the process of removal for lamp, lens, or filter replacement, the user is subject to burns from the intense heat radiating from the lamp. One solution to these problems is to create lighting fixtures larger in size. However, the small size of the lighting fixture is usually the attractive feature that draws customers to purchase these items.

A related problem with overhead lighting is that its placement is within a flat or sloping ceiling structure, an area typically difficult and cumbersome to access. A user replacing a lamp, lens, or filter typically must stand on a step stool or ladder to disengage the lamp, lens, or filter from the lighting fixture. The overhead adjustable lighting fixtures in the art do not have means for permitting easy lamp, lens, or filter replacement.

SUMMARY OF THE INVENTION

The foregoing problems are solved and a technical advance is achieved by the present invention. Disclosed is a lighting fixture having a structure amenable for easy lamp, lens, or filter replacement. The invention broadly relates to a lighting fixture apparatus comprising a frame, a gimble ring, and a lamp. The frame comprises a stop edge and at least one recess, and the gimble ring comprises an interior and exterior portion and at least one guide pin extending from the exterior portion. The guide pin fits within the recess of the frame and rotates until it reaches the stop edge to lock the gimble ring in place or to align with the recess for removal.

DETAILED DESCRIPTION OF THE INVENTION

While this invention is susceptible to embodiments of different forms as specifically disclosed herein, the invention is not intended to be limited thereto. A person of ordinary skill in the art will recognize that various other configurations may be made without departing from the scope of the invention as described by the appended claims.

Structure

Figure 1:
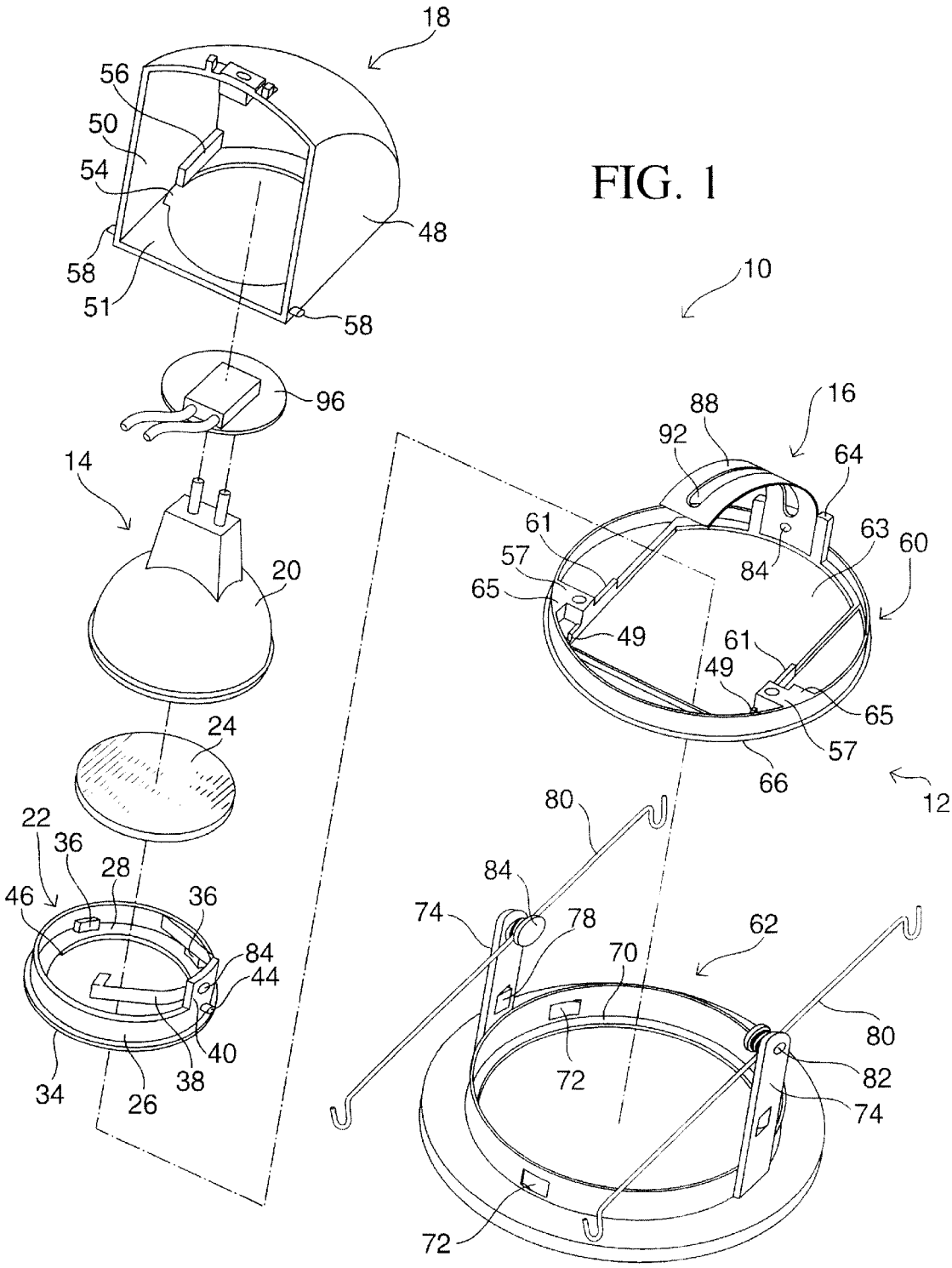
FIG. 1 is an exploded planar perspective view of a lighting fixture apparatus.
Figure 3:
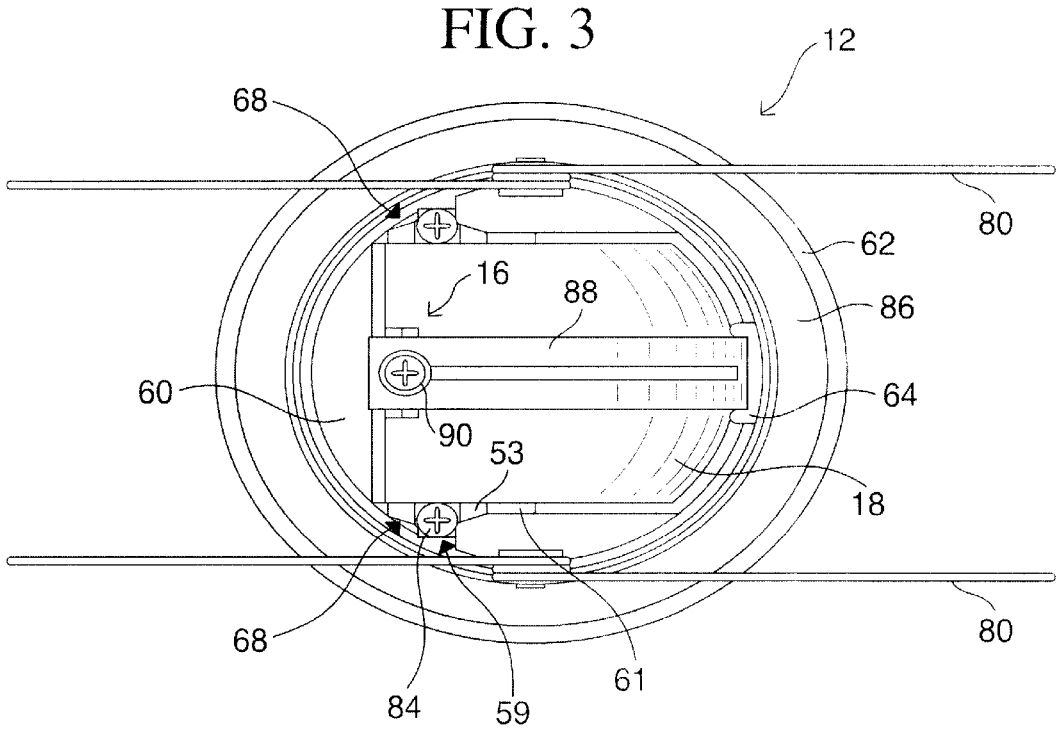
FIG. 3 is top view of a lighting fixture apparatus.

FIG. 1 depicts a lighting fixture 10 for placement into a ceiling structure (not shown). Lighting fixture 10 generally comprises housing portion 12, elbow portion 14, sliding mechanism 16, and fastening portions 68 (FIG. 3). Housing portion 12 affixes lighting fixture 10 to a recessed can (not shown) in the ceiling structure and houses elbow portion 14. Elbow portion 14 comprises frame 18, lamp 20, gimble ring 22, and lens 24.

Figure 2:
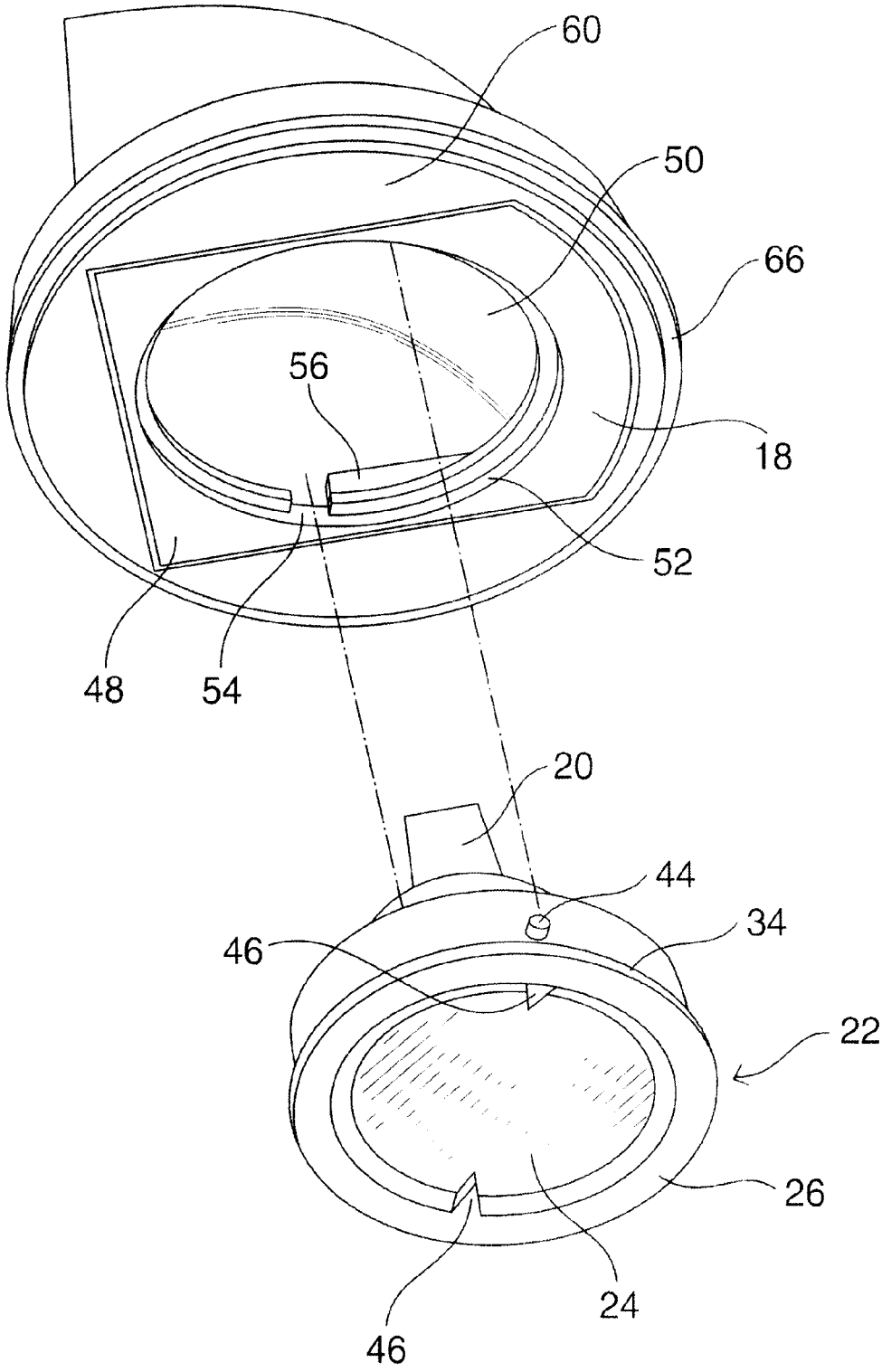
FIG. 2 is is an exploded base perspective view of the elbow portion of a lighting fixture apparatus.
Figure 5:
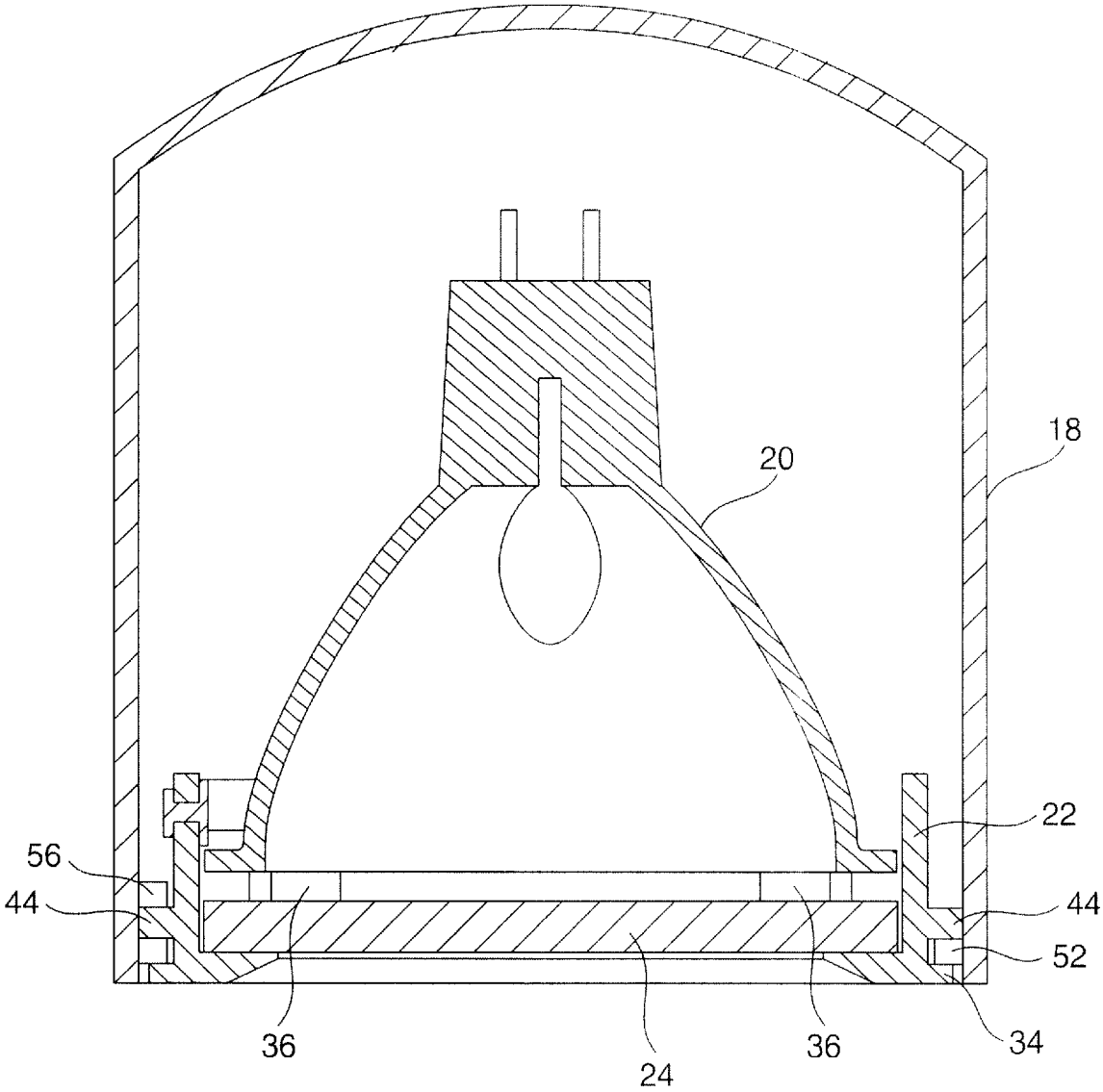
FIG. 5 is a cross-sectional view of the gimble ring 22, the lens 24, and the lamp 20 housed within the frame 18.

As described in more detail below, gimble ring 22 seats within frame 18 and holds lamp 20 by spring retainer 38. Frame 18 comprises exterior portion 48 and interior portion 50. Base 51 surrounds the inner perimeter of interior portion 50. Referring to FIGS. 1 and 2, gimble ring 22 has exterior and interior portions 26 and 28, respectively. Flange 34 extends outward from gimble ring 22 and rests on recessed guide 52 of frame 18. Connectors affix gimble ring 22 to frame 18. In one embodiment, at least one guide pin 44 protrudes from exterior portion 26 above flange 34 of gimble ring 22. Guide pin 44 is sized to fit within recess 54 of frame recessed guide 52. In one embodiment, two recesses 54 receive two guide pins 44. Once guide pins 44 are placed within recesses 54, gimble ring 22 is rotated by the user a predetermined distance until it reaches stop edge 56 to detachably secure gimble ring 22 in place. Stop edge 56 protrudes from the interior portion 50 of frame 18. In one embodiment, frame 18 has one stop edge 56 which permits up to approximately 180° of rotation of gimble ring 22 (FIG. 5). Finger tabs 46 extend inward from exterior portion 26 for engagement of the user's fingers thereof and for easy rotation of gimble ring 22. In one embodiment, two finger tabs 46 are spaced at a distance of approximately 180° from each other. Upon a counterclockwise rotation, gimble ring 22 is released from frame 18 when guide pins 44 reach stop edge 56 which corresponds with recesses 54 and either gravity or the user lowers gimble ring 22 out of frame 18. Gimble ring 22 rotates clockwise within frame 18 to secure gimble ring 22 within frame 18.

Frame 18 and gimble ring 22 are comprised of metal, and in one embodiment, aluminum alloy 380, with a white, black or satin chrome or polished brass finish. Further, frame 18 and gimble ring 22 may comprise other materials, such as heat resistant plastic.

It should be noted that stop edge 56 can take various forms, sizes and locations along base 51 such that it creates a stop for the rotation of gimble ring 22 for easy removal thereof.

One skilled in the art will appreciate that the connectors for detachably affixing gimble ring 22 to frame 18 may take various other forms. For example, connectors that may be used include, but are not limited to, conventional threading, clasps, screws, spring fasteners, etc.

Further, as seen in FIG. 1, gimble ring 22 is designed to receive lens 24 between gimble ring 22 and lamp 20. In one embodiment, four steps 36 extend from interior portion 28 of gimble ring 22 (FIG. 5). Lens 24 is of a predetermined thickness and seats within steps 36 of gimble ring 22 as illustrated in FIG. 5. When gimble ring 22 affixes to frame 18, as described above, gimble ring 22 retains lens 24 upon the vertical inversion of lighting fixture 10. As illustrated in FIG. 5, the height of steps 36 is such as to accommodate all lens 24 and filter thicknesses so as to space the lamp 20 off of the lens 24 to reduce heat transferred to the lens 24. Steps 36 dissipate heat from lamp 20 to gimble ring 22, frame 18, and housing portion 12.

Lamp 20, in one embodiment, is a MR-16 lamp commercially available from various manufacturers. Lamp 20 is connected to a lamp socket 96 within frame 18. MR-16 lamps are 12 or 24 volts and therefore will require a step down transformer as is known in the art. Lamp 20 is also housed within frame 18 and detachably affixes to gimble ring 22 by lamp retaining means. By way of example, in one embodiment illustrated in FIG. 1, extension portion 40 extends from a side of gimble ring 22 having a hole (obscured by fastener 84) for receiving spring retainer 38. Fastener 84, such as a rivet, affix spring retainer 38 to extension portion 40. Lamp 20 detachably affixes to spring retainer 38 for easy lamp replacement.

Lens 24 is comprised of glass or heat resistant plastic. Lens 24 may also include but is not limited to glass diffuser lenses and filter lenses. Lens 24 may be shaded or tinted to reduce a glare or modify the color of the light traveling from lamp 20. Lens 24 may have a smooth surface or a textured surface to transmit light from lamp 20 in various directions or shapes. Further, lens 24 may have filtering characteristics and/or provide UV protection. For example, lens 24 may include, but is not limited to, beam control lenses, color filter lenses, and dichroic lenses. Lens 24 complies with Underwriter Laboratory guidelines by capturing broken pieces of lamp 20 if lamp 20 should burst. In one embodiment, a metal mesh hexagonal cell louver (not shown) replaces lens 24 for beam control. It is to be understood that hereinafter, lens 24 refers to any of the types of lenses discussed herein.

In another embodiment, lens 24 lies substantially parallel to a cover glass (not shown) integral with a MR-16 lamp 20 when lamp 20 is inverted in the ceiling structure. Lens 24 seats within steps 36 of gimble ring 22 in the manner described above.

Housing portion 12 mounts elbow portion 14 of lighting fixture 10 to the ceiling structure. Referring to FIGS. 1 and 3, housing portion 12 comprises trim plate 60, trim ring 62, fastening portions 68, and gasket 86. The exterior of trim ring 62 is flush with the ceiling structure. Gasket 86, in one embodiment a polyurethane foam ring, rests between trim ring 62 and the ceiling structure. Trim ring 62 is circular with a predetermined diameter across flange 70. Guide 66 of trim plate 60 has substantially the same diameter as flange 70 of trim ring 62. Guide 66 in trim plate 60 seats in flange 70 while still allowing horizontal rotational movement.

Trim ring 62 comprises two base portions and at least one trim ring arm 74 welded to one another during manufacture. Trim ring 62 is comprised of metal, including but not limited to steel, with a white, black or satin chrome or polished brass finish. Further, trim ring 62 may comprise other materials, such as heat resistant plastic. Lugs 72 and 78 are also manufactured into trim ring 62 and pivot for use in the apparatus or flushed for non-use. Referring to FIG. 1, "L"-shaped retaining lugs 72 are formed inward from trim ring 62 to securely capture trim plate 60. Retaining lugs 72, however, do not restrict the rotation of trim plate 60. Trim ring arms 74 extend from trim ring 62 perpendicular to trim plate 60. Springs 80 hold housing portion 12 to the ceiling structure and may be made from spring steel wire and the like. Springs 80 are detachably secured to trim rings arms 74 by conventional fasteners 84 through holes 82. Lower lug 78 protrudes from one or more trim ring arms 74. Lower lug 78 is formed inward, toward the center of trim plate 60, to contact rotation stop 64 of trim plate 60. Once rotation stop 64 engages lower lug 78, rotation of trim plate 60 is stopped. Lower lug 78 and rotation stop 64 prevent trim plate 60 from rotating beyond a predetermined distance. This mechanism permits movement of the elbow portion 14 along a horizontal axis and prevents entanglement of the electrical wiring as required by Underwriter Laboratory standards. Further, the mechanism prevents shortening in the length of the wiring caused by continuous rotation which assures gimble ring 22 will lower to its greatest extent from the ceiling structure.

In one embodiment, as depicted in FIG. 1, two trim ring arms 74 stand substantially parallel to each other. Each trim ring arm 74 has a lower lug 78, but only one lower lug 78 is formed inward to contact rotation stop 64. This permits up to approximately 360° rotation of trim plate 60 inside trim ring 62.

As depicted in FIGS. 1 and 3, elbow portion 14 is pivotally mounted to housing portion 12 for movement about a vertical axis. Trim plate 60 has an opening 63 for displacement of elbow portion 14 along a vertical axis through housing portion 12. Further, trim plate 60 in combination with frame 18 is sized to block the sight of electrical and internal lighting fixture components (not shown) to viewers below. Trim plate 60 is comprised of metal, and in one embodiment, aluminum alloy 380, with a white, black or satin chrome or polished brass finish. Further, trim plate 60 may comprise other materials, such as heat resistant plastic. Sliding mechanism guides elbow portion 14 through housing portion 12 about a vertical axis.

Figure 4:
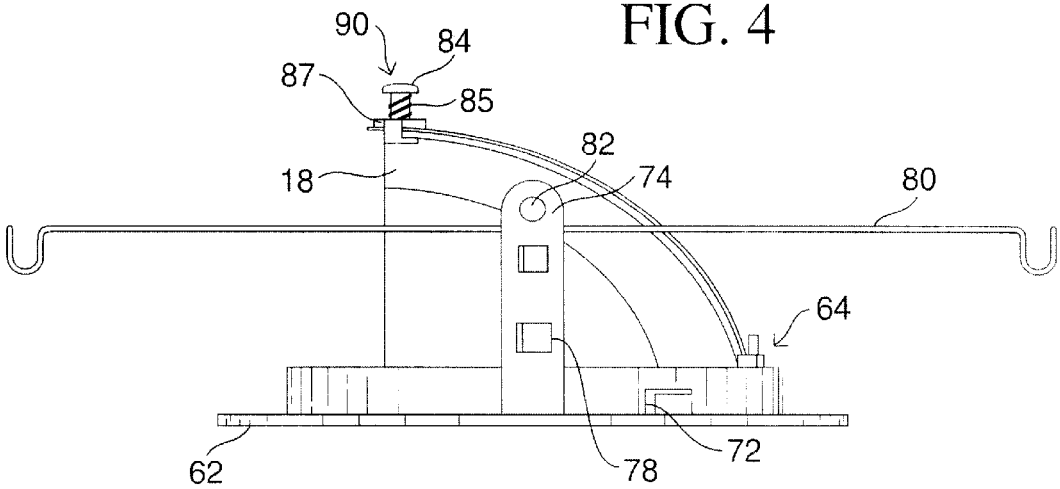
FIG. 4 is a side view of a lighting fixture apparatus.

Referring to FIGS. 1 and 4, sliding mechanism 16 comprises a bracket guide 88, guide slot 92, and tensioning means 90. Bracket guide 88 extends from trim plate 60 around frame 18 allowing elbow portion 14 to vertically swivel through opening 63 of housing portion 12. Tensioning means 90 comprises fastener 84, spring coil 85, and washer 87. Fastener 84 ais tightened sufficiently against tension from spring coil 85 to adequately hold frame 18 in any pivoted position. Tensioning means 90 glides through guide slot 92 of bracket guide 88 to hold elbow portion 14 in an aiming position determined by the user. Bracket guide 88 fastens to trim plate 60 of housing portion 12 by fastener 84 and to frame 18 by tensioning means 90. In one embodiment, bracket guide 88 forms a 90° arc from trim plate 60 to frame 18 allowing elbow portion 14 to vertically swivel up to approximately 75° through opening 63 of housing portion 12 (FIG. 4).

Referring to FIGS. 1 and 3, fastening portions 68 secure frame 18 to trim plate 60. Pivot prongs 58 extend from exterior portion 48 of frame 18 and seat in semi-circular notches 49 on trim plate 60 when frame 18 affixes to trim plate 60. Elbow retaining clips 59 seat on clip mounting bosses 57 of trim plate 60 and are secured to bosses 57 by fasteners 84. Legs 53 of clips 59 rest on ledges 61 protruding from trim plate 60 to prevent legs 53 of clips 59 from pinching pivot prongs 58 inside notches 49. Legs 53 provide clearance for pivot prongs 58 inside notch 49 thereby assuring free rotation of pivot prongs 58 inside notch 49. Boss steps 65 protrude laterally from bosses 57 on trim plate 60 to prevent clips 59 from rotating with fasteners 84 when being secured into bosses 57. Boss steps 65 are positioned on bosses 57 so that upon clockwise tightening rotation of fasteners 84, clips 59 do not rotate with fasteners 84. Boss steps 65 also prevent clips 59 from scratching frame 18 when frame 18 is swiveled vertically.

Operation

To replace lamp 20 or lens 24 in an operational lighting fixture 10 while in the ceiling, the users' fingers are placed against finger tabs 46 of gimble ring 22. The user rotates gimble ring 22 until at least one guide pin 44 reaches stop edge 56 of frame 18. At this point, at least one guide pin 44 is automatically aligned with at least one recess 54. Gravity allows gimble ring 22 containing lens 24 and lamp 20 to lower out of lighting fixture 10. In one embodiment, the user rotates gimble ring 22 counterclockwise to release gimble ring 22 from frame 18. Lamp 20 is disconnected from lamp socket 96. The user then detaches lamp 20 from gimble ring 22 by pulling lamp 20 out of spring retainer 38.

After lamp 20 is replaced with a new lamp 20 or lens 24 is replaced with a new lens 24, lens 24 is placed inside steps 36 of gimble ring 22. Lamp 20 slides into gimble ring 22 above lens 24 and attaches to gimble ring 22 by placement into spring retainer 38. Lamp 20 adjoins gimble ring 22 at steps 36. Lamp 20 is reconnected to lamp socket 96. Gimble ring 22, lens 24, and lamp 20 affix to lighting fixture 10 by placing guide pins 44 of gimble ring 22 into recesses 54 of frame 18. Pressure must be applied against gimble ring 22 to resist gravity. The users' fingers are then placed on finger tabs 46 to rotate gimble ring 22 inside frame 18 until a guide pin 44 reaches stop edge 56 and prevents further rotation of gimble ring 22. In one embodiment, the user rotates gimble ring 22 clockwise within frame 18 to secure gimble ring 22 within frame 18.

While this invention is susceptible to embodiments of different forms as specifically disclosed herein, the invention is not intended to be limited thereto. A person of ordinary skill in the art will recognize that various other configurations may be made without departing from the scope of the invention as described by the appended claims.

I claim:

1. A lighting fixture apparatus, comprising:

(a) a frame comprising a stop edge and at least one recess; and (b) a ring comprising an interior portion, an exterior portion, at least one guide pin extending from the exterior portion to detachably affix the ring to the frame, wherein the at least one guide pin fits within the at least one recess of the frame.

2. The apparatus of claim 1, further comprising a lamp, wherein the at least one recess is hidden from view.

3. The apparatus of claim 2, further comprising a lens disposed between the ring and the lamp.

4. The apparatus of claim 1, wherein the ring is a lamp retention ring and wherein the lamp retention ring comprises at least one step extending from the interior portion.

5. The apparatus of claim 1, wherein the ring is configured to be rotated within the frame to secure the ring.

6. The apparatus of claim 5, wherein the ring is a lamp retention ring and wherein the lamp retention ring is configured to be rotated clockwise within the frame to secure the lamp retention ring.

7. The apparatus of claim 5, wherein the ring is a lamp retention ring and wherein the lamp retention ring is configured to be rotated counterclockwise within the frame to release the lamp retention ring.

8. The apparatus of claim 5, wherein the ring is configured to be rotated approximately 180° within the frame.

9. The apparatus of claim 1, wherein the exterior portion of the ring further comprises at least one finger tab.

10. The apparatus of claim 2, the apparatus further comprising a lamp retaining means affixed to the ring.

11. The apparatus of claim 2, wherein the lamp retaining means comprises an extension portion and a spring retainer attached thereto, wherein the lamp is connected to a lamp socket having at least one wire, and wherein the at least one wire is positioned to provide resistance to a rotational movement of the ring about an axis that is perpendicular to a plane of the ring and extends through the lamp.

12. A lighting fixture apparatus, comprising:

(a) a frame;

(b) a lamp housed within the frame;

(c) a ring detachably affixed to the frame, comprising an interior portion, an exterior portion, and at least one step extending from the interior portion;

(d) a lens disposed between the ring and the lamp; and (e) connectors to detachably connect the ring to the frame.

13. The apparatus of claim 12, wherein the connectors comprise at least one guide pin extending from the exterior portion of the ring, at least one recess in the frame, and a stop edge extending from the frame, wherein the at least one guide pin fits within the at least one recess and is configured to interact with the stop edge so as to prevent rotation in at least one direction.

14. The apparatus of claim 13, wherein the ring is a lamp retention ring, the apparatus further comprising a lamp retaining means affixed to the lamp retention ring.

15. The apparatus of claim 14, wherein the lamp retaining means comprises an extension portion and a spring retainer attached thereto, wherein the at least one recess is hidden from view, wherein the lamp is connected to a lamp socket having at least one wire, and wherein the at least one wire is positioned to provide resistance to a rotational movement of the ring about an axis that is perpendicular to a plane of the ring and extends through the lamp.

16. The apparatus of claim 12, wherein the ring is rotatable within the frame to secure the lamp retention ring.

17. The apparatus of claim 16, wherein the ring is a lamp retention ring and wherein the lamp retention ring is configured to be rotated clockwise within the frame to secure the lamp retention ring.

18. The apparatus of claim 16, wherein the ring is a lamp retention ring and wherein the lamp retention ring is configured to be rotated counterclockwise within the frame to release the lamp retention ring.

19. The apparatus of claim 16, wherein the ring is configured to be rotated approximately 180° within the frame.

20. The apparatus of claim 12, wherein the exterior portion of the ring further comprises at least one finger tab.

21. An adjustable lighting fixture apparatus, comprising:

(a) an elbow portion comprising (i) a frame comprising a stop edge, at least one recess, and pivot prongs, (ii) a ring comprising an interior portion, an exterior portion, at least one guide pin extending from the exterior portion to detachably affix the ring to the frame, and at least one step extending from the interior portion, wherein the at least one guide pin fits within the at least one recess of the frame, (iii) a lamp, and (iv) a lens disposed between the ring and the lamp;

(b) a housing portion comprising
(i) a trim ring comprising at least two trim ring arms,
(ii) a trim plate detachably affixed to the trim ring and comprising an opening to permit movement of the elbow portion through the opening and notches to permit the pivot prongs of the frame, and
(iii) springs fastened to the at least two trim ring arms;
(c) a sliding mechanism configured to guide the elbow portion through the housing portion; and
(d) a fastening portion.

22. The apparatus of claim 21, wherein the fastening portion comprises clip mounting bosses, elbow retaining clips, fasteners, and boss steps configured to secure the pivot prongs of the frame to the trim plate.

23. The apparatus of claim 21, wherein the trim plate further comprises a ledge and wherein the at least one recess is hidden from view.

24. The apparatus of claim 21, wherein the trim ring further comprises at least one retaining lug, wherein the lamp is connected to a lamp socket having at least one wire, and wherein the at least one wire is positioned to provide resistance to a rotational movement of the ring about an axis that is perpendicular to a plane of the ring and extends through the lamp.

25. The apparatus of claim 21, wherein the trim plate is configured to permit rotation of the elbow portion about a horizontal axis.

26. The apparatus of claim 21, further comprising a gasket seated within the trim ring.

27. The apparatus of claim 26, wherein the gasket is a polyurethane foam ring.

28. The apparatus of claim 21, wherein the trim plate further comprises a rotational stop.

29. The apparatus of claim 21, wherein one of the at least two trim ring arms further comprises a lower lug.

30. The apparatus of claim 21, wherein the trim plate rotates up to approximately 360° inside the trim ring.

31. The apparatus of claim 21, further comprising electrical components, wherein the trim plate and the frame are configured to substantially block sight of the electrical components.

32. The apparatus of claim 21, wherein the sliding mechanism is configured to permit the elbow portion to swivel about a vertical axis through the plate trim.

33. The apparatus of claim 21, wherein the sliding mechanism is configured to permit the elbow portion to swivel up to 75° about a vertical axis.

34. The apparatus of claim 21, wherein the sliding mechanism further comprises tensioning means.

35. The apparatus of claim 21, wherein the ring is a lamp retention ring, the apparatus further comprising a lamp retaining means affixed to the lamp retention ring.

36. The apparatus of claim 35 wherein the lamp retaining means comprises an extension portion and a spring retainer attached thereto.

37. A method for relamping an adjustable lighting fixture apparatus having a frame comprising a stop edge and at least one recess, a ring comprising an interior portion, an exterior portion, and at least one guide pin extending from the exterior portion, and a first lamp, the method comprising:

(a) removing the first lamp from the adjustable lighting fixture apparatus by
(i) placing the user's fingers against finger tabs,
(ii) rotating the ring until the at least one guide pin abuts the stop edge and automatically aligns within the recess of the frame,
(iii) lowering the ring containing a lens and the first lamp out of the lighting fixture,
(iv) disconnecting the first lamp from a lamp socket, and
(v) detaching the first lamp from the ring;
(b) presenting a second lamp; and
(c) arranging the second lamp into the lighting fixture apparatus by
(i) placing the lens inside the steps of the ring,
(ii) attaching the second lamp to the ring,
(iii) connecting the second lamp to the lamp socket,
(iv) placing the guide pins of the ring into the recesses of the frame,
(v) placing the user's fingers on the finger tabs, and
(vi) rotating the ring inside the frame until the guide pin reaches the stop edge.

38. The method of claim 37, further comprising locking the ring into the lighting fixture by rotating the lamp retention ring inside the frame until the guide pin reaches the stop edge.

39. The method of claim 37, wherein the ring is a lamp retention ring and wherein the lamp retention ring is rotated counterclockwise within the frame until the guide pin reaches the stop edge to release the lamp retention ring from the frame.

40. The method of claim 37, wherein the ring is a lamp retention ring and wherein the lamp retention ring is rotated clockwise within the frame to secure the lamp retention ring within the frame.

41. The method of claim 37, wherein the ring is rotated approximately 180° within the frame to release or secure the ring within the frame.

42. The method of claim 37, after (i) placing the user's fingers against finger tabs and before (ii) rotating the ring, the method further comprising the step of pressing up against the ring to raise the at least one guide pin away from a base of the frame, wherein the force of gravity and force from wires resist the raising of the ring.

43. The method of claim 37, wherein the recess of the frame is not visible so as to be a blind recess, the method further comprising providing a signal that indicates that the at least one guide pin is aligned within the recess of the frame.

44. The method of claim 43, wherein (ii) rotating the ring until the at least one guide pin abuts the stop edge provides the signal that indicates that the at least one guide pin is aligned within the recess of the frame.

45. A system for lamp retention and relamping in an adjustable trim lighting fixture, the system comprising:

(a) a frame comprising a base having a cutout that includes a recess and a stop edge positioned within an interior of the frame; and
(b) a ring comprising a guide pin, where the ring and the frame are configured to be disposed in a first position at which the guide pin is in registration with the stop edge so as to secure the ring in a first direction, where the ring and the frame are configured to be disposed in a second position at which the guide pin is disposed within the cutout such that the ring is no longer secured in the first direction, and
(c) wherein the guide pin abuts the stop edge in the first position and in the second position.

46. The system of claim 45, wherein the frame further comprises a first pivot prong, a second pivot prong, and a tension device, the system further comprising a trim plate having a first notch, a second notch, and a slide mechanism, wherein the first pivot prong is disposed in the first notch, the second pivot prong is disposed in the second notch, and the tension device is in registration with the slide mechanism.

47. The system of claim 46, further comprising a trim ring having at least one lug, wherein the trim plate is positioned within the trim ring and the at least one lug securely captures the trim plate in at least a first direction without restricting rotational movement of the trim plate in a second direction.

48. The system of claim 47, wherein the ring comprises a spring retainer that is configured to receive a lamp.

49. A method to relamp an adjustable trim lighting fixture, the method comprising:

(a) presenting a frame comprising a base having a cutout that includes a recess and a stop edge positioned within an interior of the frame, wherein a ring comprising a guide pin and a first lamp positioned within the ring are secured to the frame in a first direction;

(b) releasing the ring from the frame by moving the ring in a first direction and then rotating the ring about the first direction until the guide pin abuts the stop edge so as to be positioned adjacent to the recess;

(c) moving the ring away from the frame in a second direction;

(d) removing the first lamp from the ring;

(e) installing a second lamp in the ring;

(f) moving the guide pin past the recess so that the guide pin is positioned within the interior of the frame; and (g) securing the ring to the frame in the first direction by rotating the ring until the guide pin is in registration with the stop edge.

50. The method of claim 49, where the second lamp is installed above a plurality of steps and a lens is installed between the plurality of steps at a predetermined distance from the second lamp and where the lens is positioned as part of the adjustable trim lighting fixture in three steps consisting of:

(a) connecting the second lamp to a lamp socket, (b) moving the guide pin past the recess so that the guide pin is positioned within the interior of the frame; and (c) securing the ring to the frame in the first direction by rotating the ring until the guide pin is in registration with the stop edge.

51. The method of claim 49, where rotating the ring comprises contacting at least one finger tap on the ring and urging the finger tap in a rotational direction.

* * * * *